US009884737B2

(12) United States Patent
Ito

(10) Patent No.: US 9,884,737 B2
(45) Date of Patent: Feb. 6, 2018

(54) SHEET SEPARATING APPARATUS

(71) Applicant: BROTHER KOGYO KABUSHIKI KAISHA, Nagoya-shi, Aichi-ken (JP)

(72) Inventor: Tetsuo Ito, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/626,451

(22) Filed: Feb. 19, 2015

(65) Prior Publication Data

US 2015/0239691 A1 Aug. 27, 2015

(30) Foreign Application Priority Data

Feb. 21, 2014 (JP) ..... 2014-031688

(51) Int. Cl.
*B65H 3/06* (2006.01)
*B65H 3/52* (2006.01)

(52) U.S. Cl.
CPC ..... *B65H 3/0684* (2013.01); *B65H 3/5223* (2013.01); *B65H 3/5207* (2013.01);
(Continued)

(58) Field of Classification Search
CPC .. B65H 3/5207; B65H 3/5223; B65H 3/0684; B65H 2404/1431
See application file for complete search history.

(56) References Cited

U.S. PATENT DOCUMENTS 6,000,689 A * 12/1999 Furuki ..... B65H 3/5261 271/10.11
6,550,759 B2 * 4/2003 Kotaka ..... B41J 13/103 271/10.11

(Continued)

FOREIGN PATENT DOCUMENTS

CN 1439524 A 9/2003
CN 101607640 A 12/2009

(Continued)

OTHER PUBLICATIONS

Office Action issued in related Chinese patent application No. 201510087492.7, dated Nov. 4, 2016.

(Continued)

*Primary Examiner* — Howard Sanders
(74) *Attorney, Agent, or Firm* — Merchant & Gould P.C.

(57) ABSTRACT

A sheet separating apparatus includes a stacker having a sheet supporting surface, a separation roller rotating around a first shaft center parallel to a width direction of the sheet supporting surface, contacting a sheet fed from the stacker and conveying the sheet to a downstream side in a conveyance direction perpendicular to the width direction, a separation piece facing the separation roller and separating the sheet one at a time in cooperation with the separation roller, the separation roller and the separation piece nipping the sheet at a first nip position, and a pinch roller provided on an upstream side with respect to the first nip position and abutting on the separation roller to be rotatable around a second shaft center parallel to the width direction, the pinch roller having a portion overlapping the separation piece as seen from the width direction.

16 Claims, 8 Drawing Sheets

(52) U.S. Cl.
CPC ..... *B65H 2404/1431* (2013.01); *B65H 2404/1521* (2013.01)

(56) References Cited

U.S. PATENT DOCUMENTS

| | | | | |
|---|---|---|---|---|
| 2003/0160381 | A1 | 8/2003 | Sonoda et al. | |
| 2005/0285329 | A1* | 12/2005 | Ikeda | B65H 3/0661 271/121 |
| 2008/0203652 | A1 | 8/2008 | Yasukawa et al. | |
| 2009/0315253 | A1 | 12/2009 | Osakabe et al. | |

FOREIGN PATENT DOCUMENTS

| | | | |
|---|---|---|---|
| CN | 202754572 | U | 2/2013 |
| JP | 1-94334 | U | 6/1989 |
| JP | 2-48340 | A | 2/1990 |
| JP | 3628602 | B2 | 3/2005 |
| JP | 2008-207944 | A | 9/2008 |
| JP | 2009-165046 | A | 7/2009 |
| JP | 2010-173846 | A | 8/2010 |

OTHER PUBLICATIONS

Office Action from corresponding Japanese Patent Application No. P2014-031688, dated Jan. 31, 2017.
Office Action from corresponding Chinese Patent Application 201510087492.7, dated Aug. 2, 2017.

* cited by examiner

SHEET SEPARATING APPARATUS

CROSS-REFERENCE TO RELATED APPLICATIONS

This application claims priority from Japanese Patent Application No. 2014-031688 filed on Feb. 21, 2014, the entire subject-matter of which is incorporated herein by reference.

TECHNICAL FIELD

The present disclosure relates to a sheet separating apparatus.

BACKGROUND

There has been disclosed an example of a sheet separating apparatus. This sheet separating apparatus has a stacking unit, a separation roller, and a separation piece. The stacking unit has a sheet supporting surface capable of supporting a plurality of sheets stacked. The separation roller rotates around a first shaft center parallel to the width direction of the sheet supporting surface, thereby coming into contact with a sheet fed from the stacking unit and conveying the sheet to the downstream side in a conveyance direction perpendicular to the width direction. The separation piece faces the separation roller, and separates sheets one at a time in cooperation with the separation roller.

However, in the above-described related-art sheet separating apparatus, according to whether the number of sheet stacked on the sheet supporting surface is large or small, a trajectory of the leading end of the sheet fed from the stacking unit to the separation roller may be likely to significantly vary. For example, in the related-art sheet separating apparatus, as will be described below, according to whether the number of sheet stacked on the sheet supporting surface is large or small, the sheet separating apparatus may not reliably separate the sheets one at a time.

For example, it is assumed that the separation roller is provided to be able to contact each sheet which is fed from the stacking unit, from a side that is opposite to a side facing the sheet supporting surface, such that the uppermost sheet of the sheets supported on the sheet supporting surface is fed to the separation roller. A nip position is defined as a position where a sheet is nipped by the separation roller and the separation piece when the sheet is fed.

In this case, if the number of sheets stacked on the sheet supporting surface is large, the trajectory of the leading end of the uppermost sheet passes a position close to the separation roller and proceeds toward the nip position. Therefore, the leading end of the corresponding sheet easily reaches the nip position. However, in this case, simultaneous conveyance of sheets may occur. Meanwhile, if the number of sheets stacked on the sheet supporting surface is small, the trajectory of the leading end of the uppermost sheet passes a position separated from the separation roller and close to the separation piece, and proceeds toward the nip position. Therefore, the leading end of the corresponding sheet may be unlikely to reach the nip position. In this case, failure of sheet conveyance may occur.

Also, the sheet separating apparatus is required to be reduced in size.

SUMMARY

Therefore, it is preferably to provide a sheet separating apparatus capable of implementing a decrease in size and capable of reliably separating sheets, one at a time, regardless of the number of sheets stacked on a sheet supporting surface.

According to one aspect of the disclosure, a sheet separating apparatus comprises: a stacker including a sheet supporting surface for supporting a sheet; a separation roller configured to rotate around a first shaft center that is parallel to a width direction of the sheet supporting surface, wherein the separation roller is configured to contact the sheet fed from the stacker and to convey the sheet to a downstream side in a conveyance direction that is perpendicular to the width direction; a separation piece, which faces the separation roller, and which is configured to separate the sheet one at a time in cooperation with the separation roller, the separation roller and the separation piece being configured to nip the sheet being fed at a first nip position; and a pinch roller, which is provided on an upstream side with respect to the first nip position in the conveyance direction, and which is configured to abut on the separation roller so as to be rotatable around a second shaft center, which is parallel to the width direction, by a rotation of the separation roller, wherein the pinch roller has a portion overlapping the separation piece as seen from the width direction.

In another aspect of the disclosure, a sheet separating apparatus comprises: a stacker that has a sheet supporting surface for supporting a plurality of sheets stacked; a separation roller configured to rotate around a first shaft center that is parallel to a width direction of the sheet supporting surface, wherein the separation roller is configured to contact a sheet fed from the stacker and to convey the sheet to a downstream side in a conveyance direction that is perpendicular to the width direction; a separation piece, which face the separation roller, and which is configured to separate the sheet one at a time in cooperation with the separation roller, the separation roller and the separation piece being configured to nip the sheet being fed at a first nip position; and a pinch roller, which is provided on the upstream side from the first nip position in the conveyance direction, and which is configured to abut on the separation roller so as to be rotatable around a second shaft center, which is parallel to the width direction, by a rotation of the separation roller, the separation roller and the pinch roller are configured to nip the sheet being fed at a second nip position, wherein as seen from the width direction, an extension plane extending from the sheet supporting surface toward the downstream side in the conveyance direction, with a gap from an outer circumferential surface of the separation roller, and wherein the outer circumferential surface of the pinch roller includes an arc that extends from a position adjacent to an end portion of the sheet supporting surface at the downstream side in the conveyance direction to the second nip position while swelling toward the separation roller.

BRIEF DESCRIPTION OF THE DRAWINGS

The present disclosure is illustrated, and not limited, by way of example by the accompanying figures in which like reference numerals indicate similar elements.

FIG. 4 is a perspective view illustrating a portion of the image reading apparatus of the first illustrative embodiment which includes a separation roller, a sheet supporting surface, a separation piece, a separation piece holder, pinch rollers, a holding unit, and so on;

FIG. 6 is a top view illustrating a portion of the image reading apparatus of the first illustrative embodiment which includes the sheet supporting surface, the separation piece, the separation piece holder, the pinch rollers, the holding unit, and the like;

FIG. 10 is a top view illustrating a portion of the image reading apparatus of the second illustrative embodiment which includes a sheet supporting surface, a separation piece, a separation piece holder, the pinch rollers, the holding unit, and the like.

DETAILED DESCRIPTION

Hereinafter, first to third illustrative embodiments will be described with reference to the accompanying drawings.

(First Illustrative Embodiment)

Figure 1:
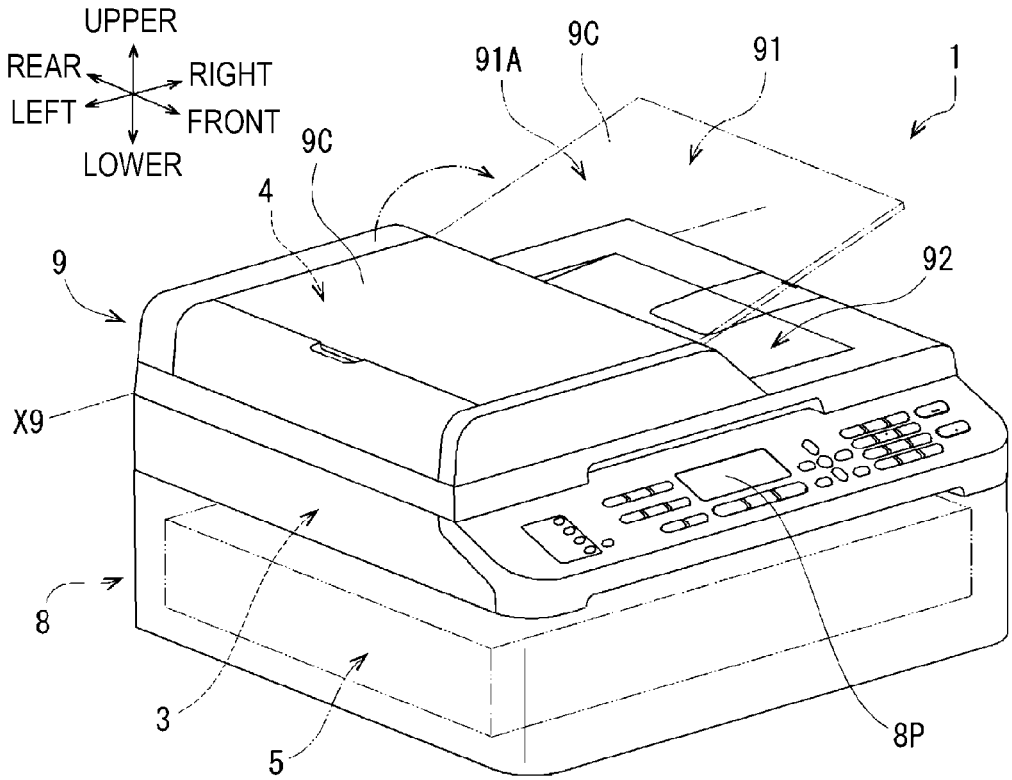
FIG. 1 is a perspective view illustrating an image reading apparatus of a first illustrative embodiment.

As shown in FIG. 1, an image reading apparatus 1 of a first illustrative embodiment is a specific example of a sheet separating apparatus. In FIG. 1, on the assumption that the operation panel (8P) side is referred to as the front side of the apparatus, and the left hand side of a user facing the operation panel 8P is referred to as the left side of the apparatus, the front side, rear side, left side, right side, upper side, and lower side of the apparatus are indicated. Further, directions shown in FIGS. 2 to 11 are indicated so as to correspond to the directions shown in FIG. 1. Hereinafter, individual components of the image reading apparatus 1 will be described with reference to some drawings such as FIG. 1.

<Configuration>

Figure 2:
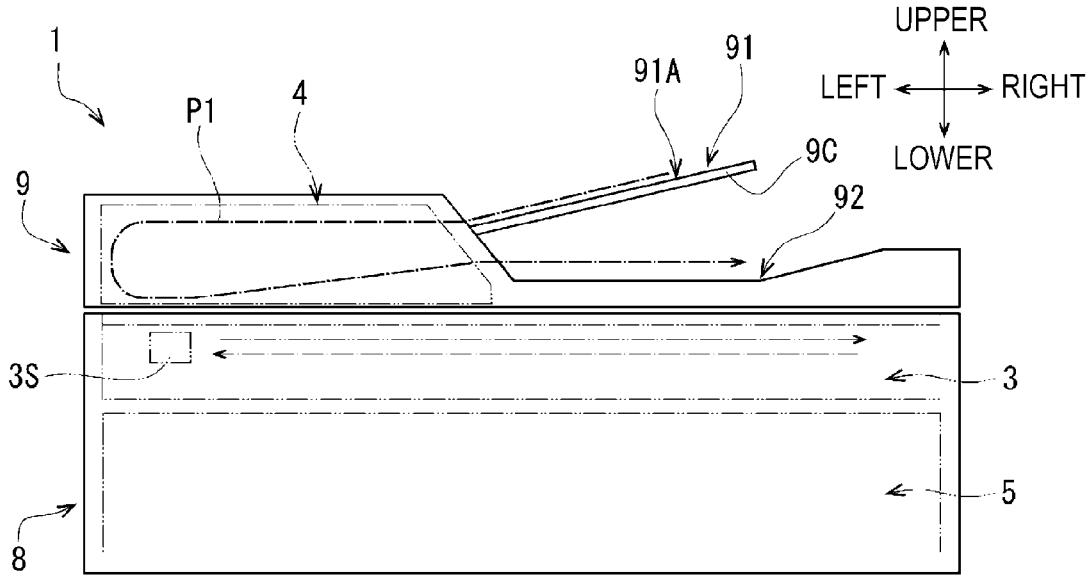
FIG. 2 is a side view schematically illustrating the image reading apparatus of the first illustrative embodiment.
Figure 3:
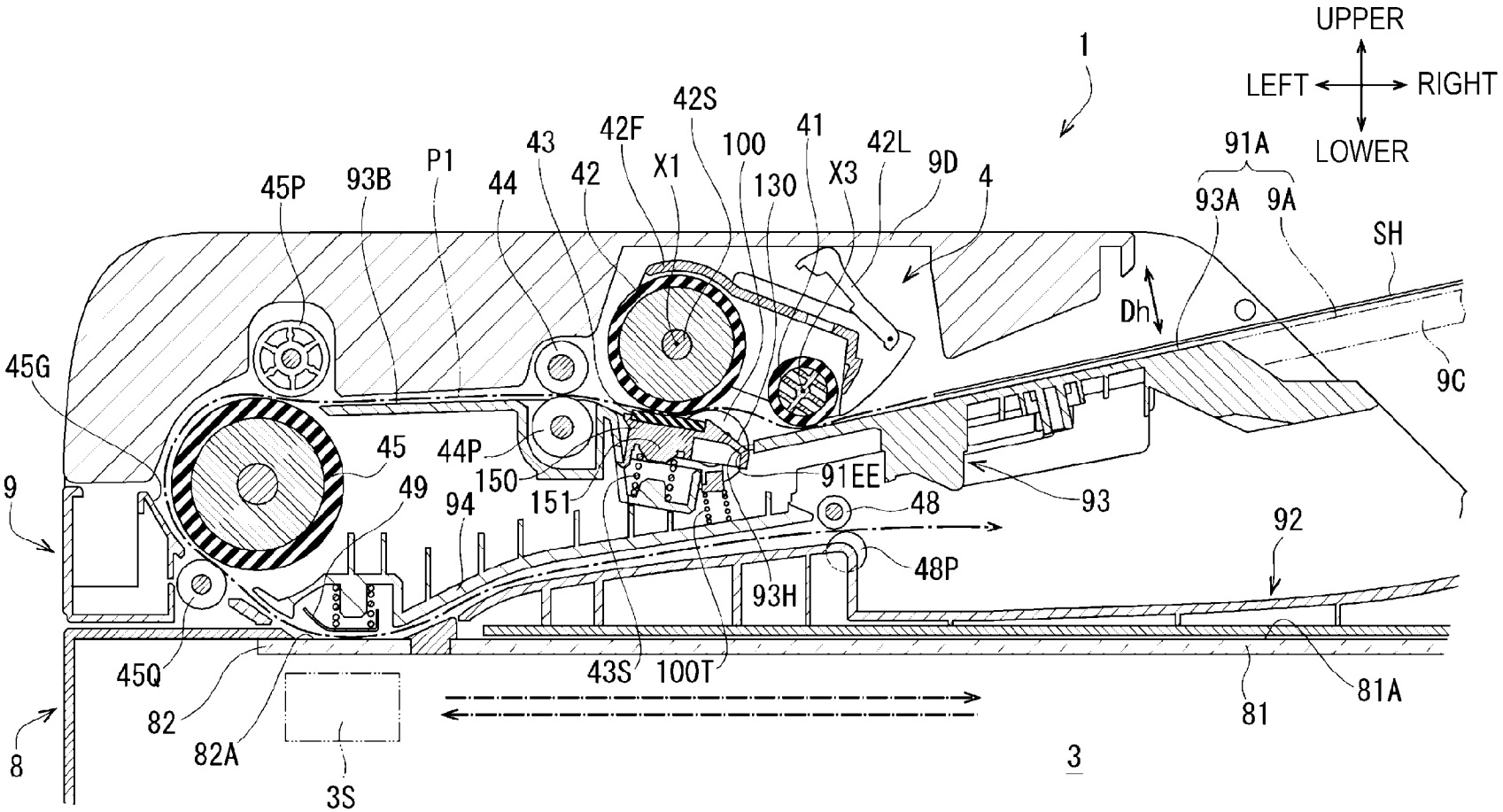
FIG. 3 is a cross-sectional view schematically illustrating a portion of the image reading apparatus of the first illustrative embodiment.

As shown in FIGS. 1 to 3, the image reading apparatus 1 includes a main body unit 8, an opening/closing unit 9, an image forming unit 5, a reading unit 3, a feeding tray 91, a discharge tray 92, and a conveyor 4. The main body unit 8 is a flat body having substantially a box shape. As shown in FIG. 1, on the front surface of the main body unit 8, the operation panel 8P which is a touch panel or the like is provided.

As shown in FIGS. 1 and 2, the image forming unit 5 is accommodated in a lower portion of the inside of the main body unit 8. The image forming unit 5 forms images on sheets by an inkjet scheme or a laser scheme.

As shown in FIG. 3, on the top surface of the main body unit 8, first platen glass 81 and second platen glass 82 are disposed. A document supporting surface 81A is formed by the top surface of the first platen glass 81. When the reading unit 3 reads the image of a document which is a read target while being in a stop state, the document supporting surface 81A supports the document from the below. Examples of the document which is a read target include sheets such as paper sheets and OHP sheets, books, etc. The second platen glass 82 is positioned on the left side of the first platen glass 81 and extends in an elongated shape in a front-rear direction. A read surface 82A is formed by the top surface of the second platen glass 82. When the reading unit 3 reads the images of sheets SH which are conveyed one at a time by the conveyor 4, the read surface 82A guides each conveyed sheet SH from the blow.

As shown in FIG. 1, the opening/closing unit 9 is supported by a hinge (not shown) disposed at the upper end edge of the rear surface side of the main body unit 8 such that it can swing around an opening/closing shaft center X9 extending in a left-right direction. In a state where the opening/closing unit 9 is closed as shown in FIGS. 1 to 3, the opening/closing unit covers the document supporting surface 81A from the above. Although not shown in the drawings, the opening/closing unit 9 swings around the opening/closing shaft center X9 such that its front end portion side is displaced to the upper rear side, whereby the opening/closing unit is displaced to an open position for exposing the document supporting surface 81A. Therefore, a user can make the document supporting surface 81A support a document which is a read target.

As shown in FIG. 3, the reading unit 3 includes a read sensor 3S which is accommodated in an upper portion of the inside of the main body unit 8, and a scanning mechanism (not shown). The read sensor 3S is positioned below the document supporting surface 81A and the read surface 82A. The scanning mechanism reciprocates the read sensor 3S in the left-right direction below the document supporting surface 81A and the read surface 82A inside the main body unit 8. As the read sensor 3S, a known image reading sensor such as a contact image sensor (CIS) or a charge coupled device (CCD) may be used.

As shown in FIGS. 2 and 3, the conveyor 4 is provided at the opening/closing unit 9. The conveyor 4 includes the feeding tray 91 and the discharge tray 92. The feeding tray 91 is formed in a right portion of the opening/closing unit 9 by spreading a closed cover 9C shown by a solid line in FIG. 1 as shown by an alternate long and two short dashes line in FIG. 2.

As shown in FIG. 3, the feeding tray 91 has a sheet supporting surface 91A. The sheet supporting surface 91A is formed by a first sheet supporting surface 9A which is a surface of the spread cover 9C directed to the upper side, and a second sheet supporting surface 93A which is a right area of the top surface of a chute member 93. The sheet supporting surface 91A is a flat surface inclined toward the lower left side. If a plurality of stacked sheets SH needs to be conveyed as s a read target by the conveyor 4, the sheet supporting surface 91A supports the sheets SH from the below. The width direction of the sheet supporting surface 91A is the front-rear direction in the present illustrative embodiment. A height direction perpendicular to the sheet supporting surface 91A is a direction Dh shown in FIGS. 3, 7, and 8. The height direction Dh is inclined with respect to a vertical direction.

The discharge tray 92 is positioned on the lower side from the feeding tray 91. After the image of a sheet SH is read by the read sensor 3S, the sheet SH is conveyed by the conveyor 4, thereby being discharged onto the discharge tray 92.

The conveyor 4 defines a conveyance path P1 as a space surrounded by guide surfaces, a conveying roller (to be described below), and the like. The guide surfaces extend inside the opening/closing unit 9 so as to be capable of abutting on both sides of each sheet SH. The conveyance path P1 first includes a portion extending almost horizontally from an end portion of the sheet supporting surface 91A of the feeding tray 91 positioned on the downstream side in the conveyance direction, toward the left side. Next, the conveyance path P1 includes a portion curved downward and making a U-turn. Next, the conveyance path P1 includes a short portion extending toward the right side along the read surface 82A. Finally, the conveyance path P1 includes a portion inclined from the downstream side of the read surface 82A in the conveyance direction toward the upper right side and leading to the discharge tray 92.

The conveyance direction of a sheet SH which is conveyed by the conveyor 4 may be a leftward direction in the substantially horizontal portion of the upper path of the conveyance path P1, and varies to be a rightward direction in the portion of the conveyance path P1 curved downward and making the U-turn, and may be a rightward direction in the portion of the lower path of the conveyance path P1 passing the read surface 82A and leading to the discharge tray 92. The conveyance direction is perpendicular to the front-rear direction which is the width direction of the sheet supporting surface 91A.

As shown in FIGS. 3 to 8, the conveyor 4 has the chute member 93, a feeding roller 41, a separation roller 42, a separation piece 43, a pair of front and rear pinch rollers 100, a holding unit 120, and an inclined surface 130.

Figure 4:
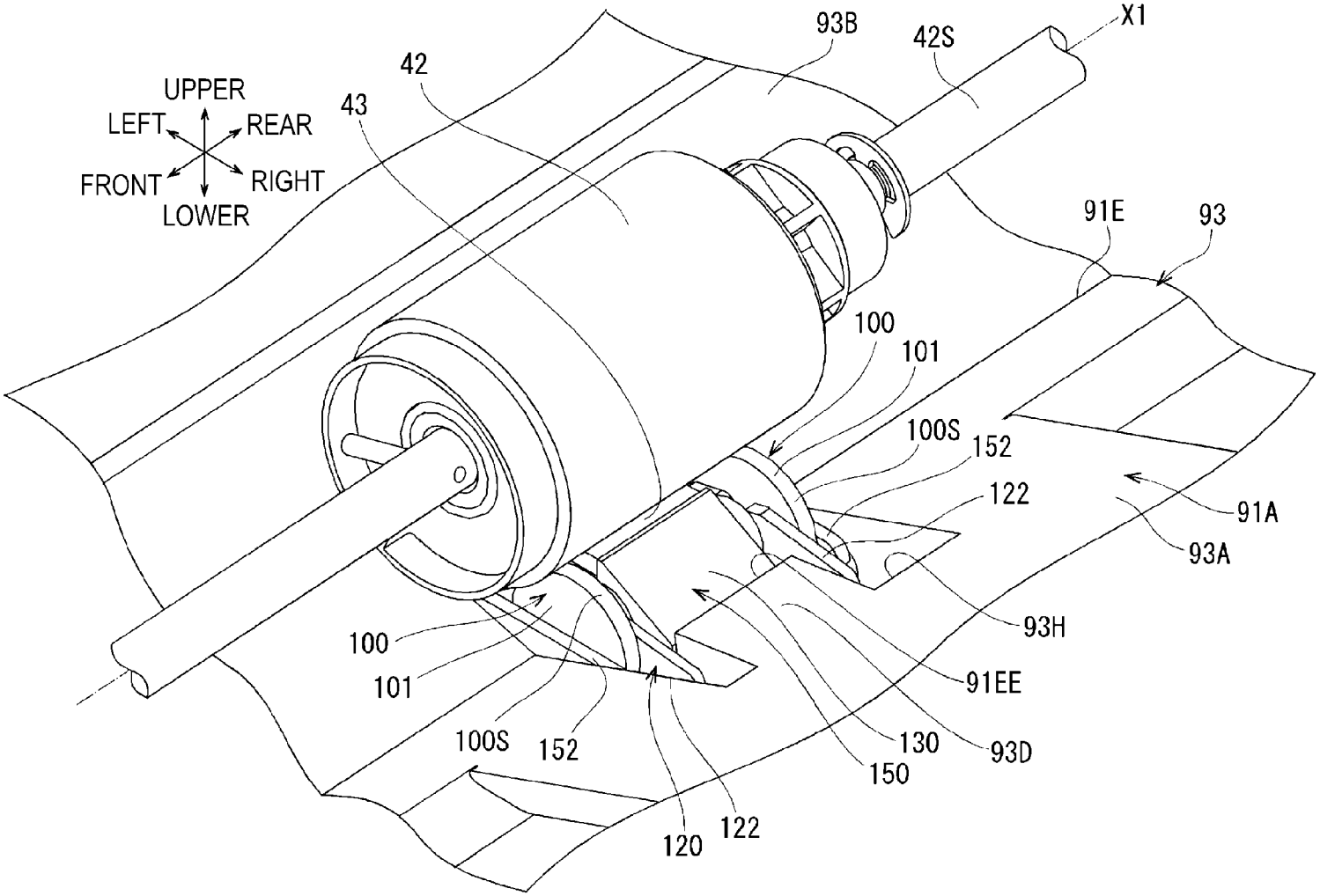
Figure 5:
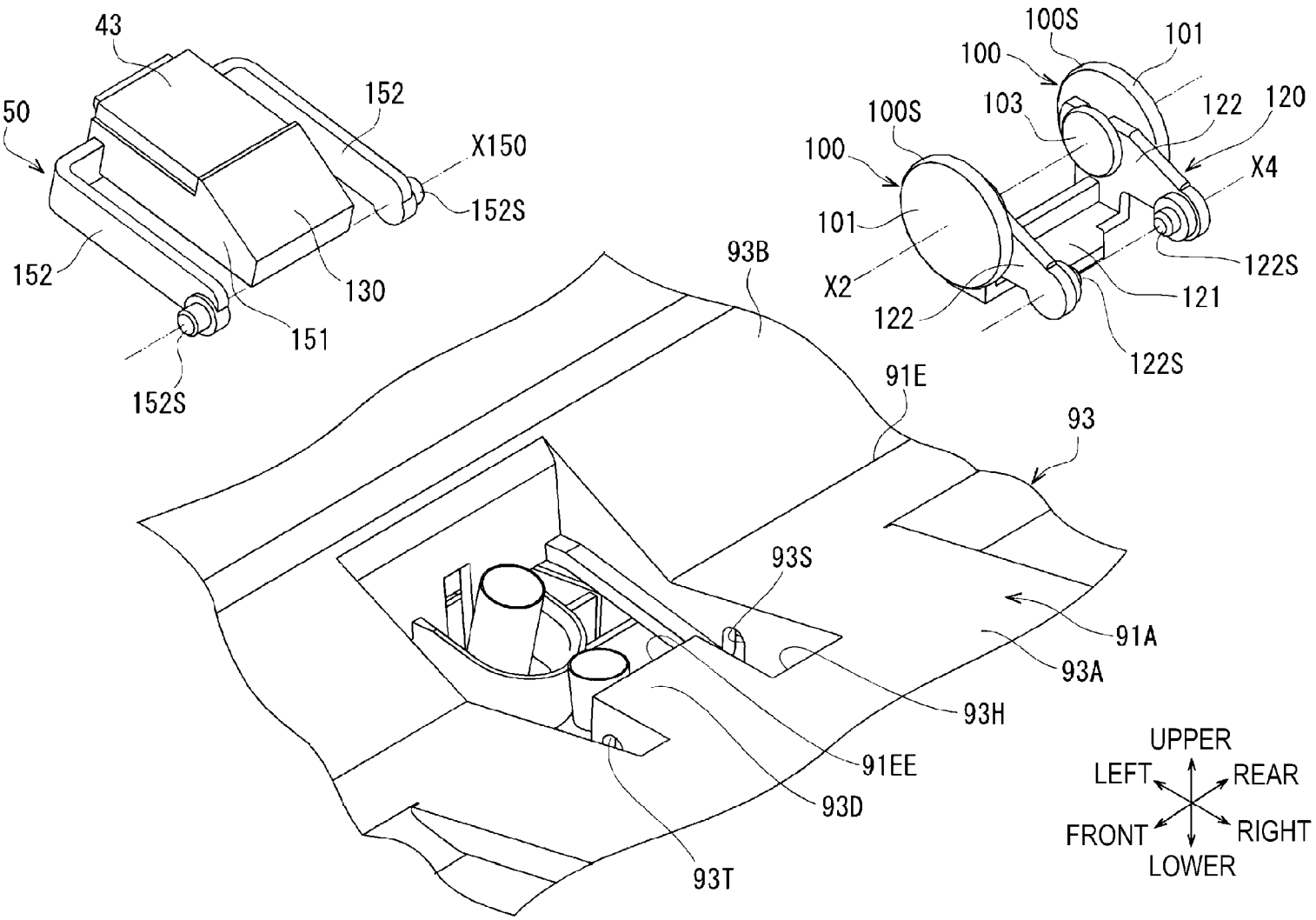
FIG. 5 is an exploded perspective view illustrating the sheet supporting surface, the separation piece, the separation piece holder, the pinch rollers, the holding unit, and the like of the image reading apparatus of the first illustrative embodiment.
Figure 6:
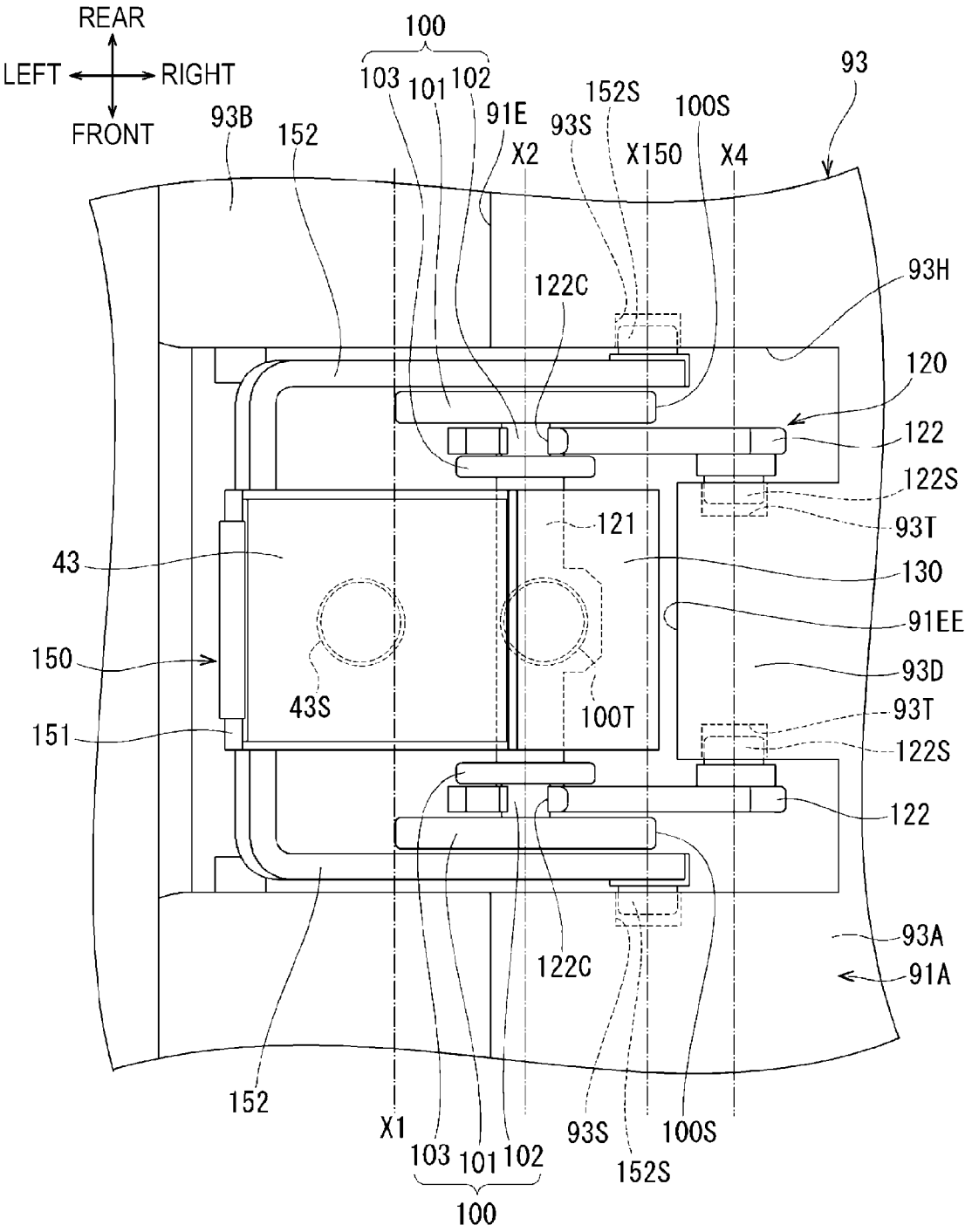

As shown in FIG. 3, the chute member 93 is a resin molding whose top surface has substantially a flat plate shape. An area of the top surface of the chute member 93 positioned on the left side from second sheet supporting surface 93A forms a guide surface 93B. More specifically, as shown in FIGS. 4 to 6, the right end portion of the guide surface 93B is connected to an end portion 91E of the sheet supporting surface 91A positioned on the downstream side in the conveyance direction, that is, the left end portion of the second sheet supporting surface 93A. The guide surface 93B is inclined from its right end portion toward the upper left side, and then extends almost horizontally. As shown in FIG. 3, the guide surface 93B forms a flat surface capable of abutting on each sheet SH from the below if the corresponding sheet SH is fed from the feeding tray 91. The guide surface 93B defines the substantially horizontal portion of the upper path of the conveyance path P1 from the below.

The separation roller 42 is provided at a position which faces the guide surface 93B of the chute member 93 from the above and is close to the second sheet supporting surface 93A of the chute member 93. The separation roller 42 is fit on a drive shaft 42S, which has a first shaft center X1 extending in the front-rear direction, as a central axis. The separation roller 42 is a roller which rotates around the first shaft center X1 integrally with the drive shaft 42S. That is, the separation roller 42 is provided so as to be able to contact each sheet SH from a side that is opposite to a side facing the sheet supporting surface 91A if the corresponding sheet SH is fed from the feeding tray 91.

On the drive shaft 42S, a holder 42F is supported so as to be able to swing around the first shaft center X1. The holder 42F protrudes from the drive shaft 42S toward the right side.

The feeding roller 41 is provided on the right side with respect to the separation roller 42, that is, on the upstream side with respect to the separation roller 42 in the conveyance direction such the feeding roller 41 faces the second sheet supporting surface 93A of the chute member 93 from the above. The feeding roller 41 is supported on the right portion of the holder 42F so as to be rotatable around a third shaft center X3 extending in the front-rear direction. That is, the feeding roller 41 is provided so as to be able to contact the sheet SH from the side that is opposite to the side facing the sheet supporting surface 91A if the sheet SH are supported on the sheet supporting surface 91A of the feeding tray 91. Although not shown in the drawings, on the holder 42F, a transmission gear group (not shown) is provided so as to transmit a rotation drive force from the drive shaft 42S to the feeding roller 41.

Figure 7:
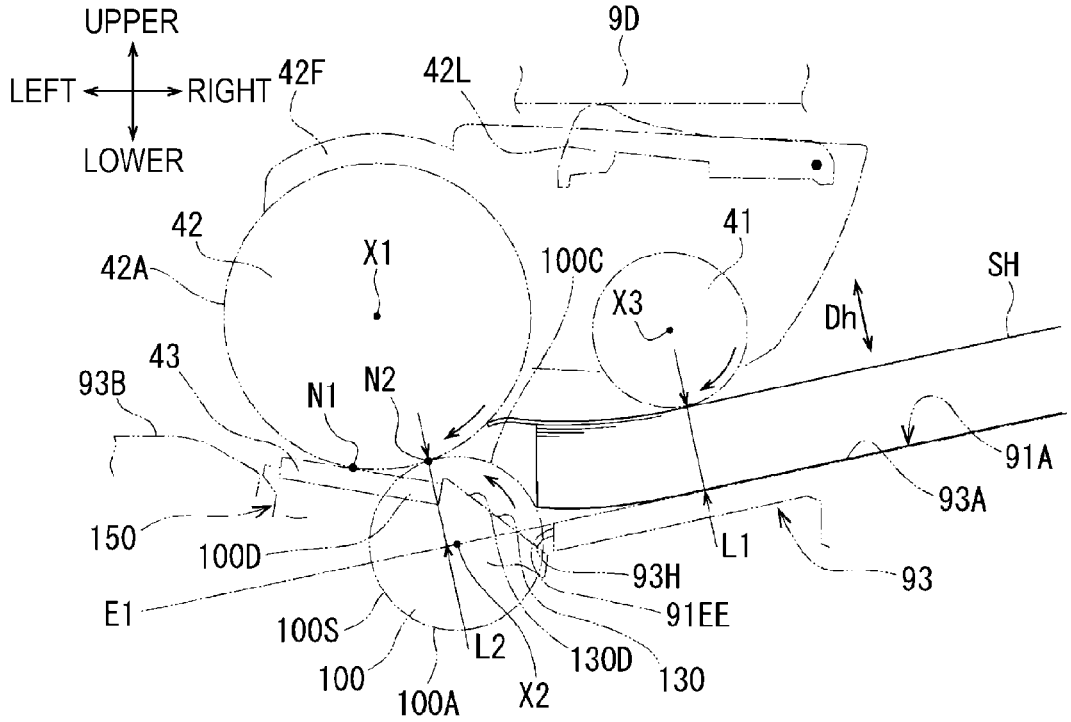
FIG. 7 is a schematic view for explaining the operations of a feeding roller, the separation roller, the separation piece, the pinch rollers, and the like in the image reading apparatus of the first illustrative embodiment.
Figure 8:
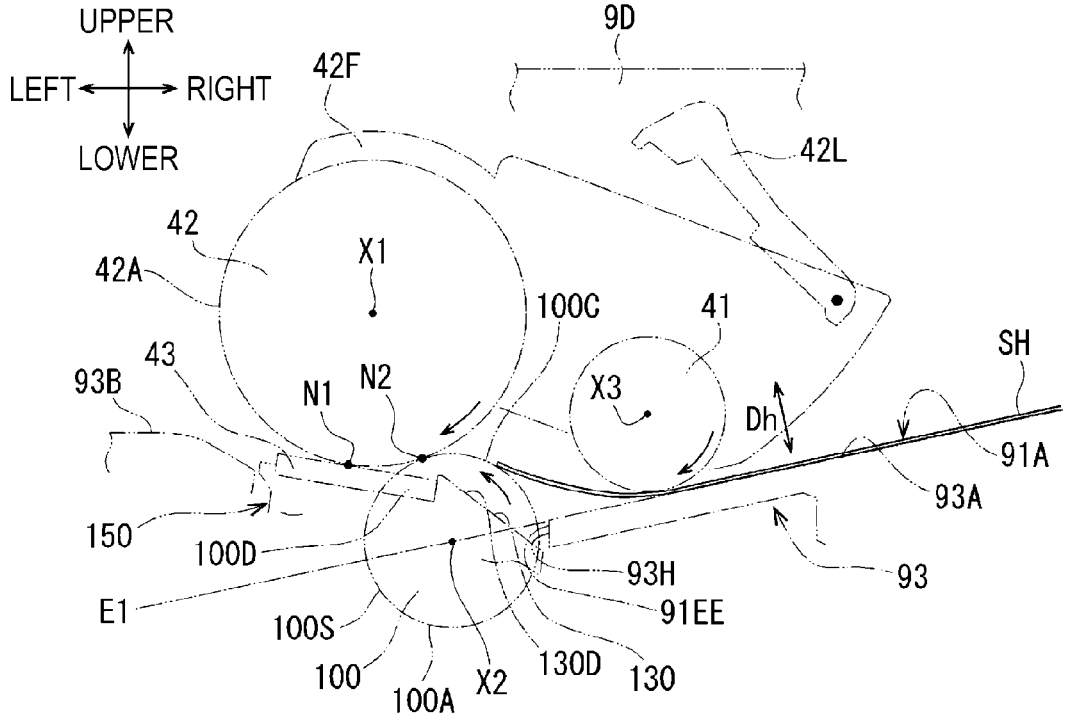
FIG. 8 is a schematic view for explaining the operations of the feeding roller, the separation roller, the separation piece, the pinch rollers, and the like in the image reading apparatus of the first illustrative embodiment.

As shown in FIGS. 3, 7, and 8, on the holder 42F, a pressing lever 42L is provided. Between the pressing lever 42L and the holder 42F, a pressing spring (not shown) is provided. The upper end portion of the pressing lever 42L is pressed by the pressing spring, thereby being pressed against the upper wall 9D of the opening/closing unit 9. As a result, the holder 42F swings around the first shaft center X1 such that the feeding roller 41 approaches the sheet supporting surface 91A.

The position of the feeding roller 41 shown in FIG. 3 is a contact position where the feeding roller 41 is in direct contact with the sheet supporting surface 91A. As shown in FIGS. 7 and 8, according to whether the number of sheets SH which are supported on the sheet supporting surface 91A is large or small, the feeding roller 41 moves closer to or farther from the sheet supporting surface 91A, thereby coming into contact with the uppermost sheet SH. The position of the feeding roller 41 shown in FIG. 7 is a maximum separation position where the feeding roller 41 is farthest away from the sheet supporting surface 91A.

If a plurality of sheets SH is supported on the sheet supporting surface 91A of the feeding tray 91, the feeding roller 41 rotates around the third shaft center X3, thereby applying a conveyance force to the uppermost sheet SH, thereby sending the corresponding sheet SH toward the separation roller 42. If the sheet SH is fed from the feeding tray 91, that is, from the upstream side in the conveyance direction, the separation roller 42 rotates while being in contact with the sheet SH, thereby conveying the sheet SH toward the left side, that is, toward the downstream side in the conveyance direction, along the substantially horizontal portion of the upper path of the conveyance path P1.

As shown in FIGS. 3 to 6, a portion of the chute member 93 positioned on the lower side from the separation roller 42 is cut out, whereby an opening 93H is formed. As shown in FIGS. 5 and 6, in the inner walls of the front side and rear side of the opening 93H, a pair of front and rear shaft receiving portions 93S is formed in a recess shape. Each shaft receiving portion 93S is positioned on the right side with respect to the first shaft center X1, that is, on the upstream side with respect to the first shaft center X1 in the conveyance direction.

The sheet supporting surface 91A includes a protruding portion 93D which protrudes toward the left side so as to penetrate into the left portion of the opening 93H. The left end edge of the protruding portion 93D configures an end portion 91EE which is a portion of the end portion 91E of the sheet supporting surface 91A positioned on the downstream side in the conveyance direction. That is, the end portion 91EE which is included in the end portion 91E of the sheet supporting surface 91A positioned on the downstream side in the conveyance direction and faces the opening 93H is positioned on the right side from the other portion of the end portion 91E, that is, on the upstream side from the other portion of the end portion 91E in the conveyance direction.

In wall surfaces extending downward from the front end edge and rear end edge of the protruding portion 93D, a pair of front and rear shaft receiving portions 93T is formed in a recess shape. The shaft receiving portions 93T are positioned on the right side with respect to the shaft receiving portions 93S.

As shown in FIGS. 3 to 8, the separation piece 43 is provided on the chute member (93) so as to face the separation roller 42 from the below. The separation piece 43 is a plate-shaped member which is formed of a soft material such as rubber or elastomer. The separation piece 43 is held by a separation piece holder 150.

As shown in FIGS. 5 and 6, the separation piece holder 150 is a resin molding which has a base portion 151 and a pair of front and rear protruding portions 152.

The base portion 151 is formed in a substantially rectangular plate shape. At the right portion of the top surface of the base portion 151, the inclined surface 130 is formed. The inclined surface 130 is inclined toward the upper left side. On the left portion of the top surface of the base portion 151, the separation piece 43 is attached.

The front protruding portion 152 protrudes from the front left corner of the base portion 151 toward the front side, and then is curved so as to protrude toward the right side. The rear protruding portion 152 protrudes from the rear left corner of the base portion 151 toward the rear side, and then is curved so as to protrude toward the right side. At the right end portions of the protruding portions 152, shaft parts 152S are formed, respectively. The front shaft part 152S and the rear shaft part 152S are cylindrical shafts, which have a pivot shaft center X150 extending in the front-rear direction, as a central axis. The pivot shaft center X150 is positioned on the right side with respect to the first shaft center X1, that is, on the upstream side with respect to the separation roller 42 in the conveyance direction. The front shaft part 152S and the rear shaft part 152S protrude in opposite directions.

As shown in FIG. 6, the shaft parts 152S of the separation piece holder 150 are fit into the shaft receiving portions 93S of the chute member 93, whereby the separation piece holder 150 is supported on the chute member 93 so as to be able to swing around the pivot shaft center X150.

As shown in FIG. 3, between the base portion 151 of the separation piece holder 150 and the bottom of the opening 93H of the chute member 93, a compression spring 43S is disposed. The compression spring 43S presses the base portion 151 upward, whereby the separation piece 43 is pressed against the separation roller 42. In a case where a plurality of stacked sheets SH is conveyed from the feeding roller 41 to the separation roller 42, the separation piece 43 separates the sheets SH one at a time, in cooperation with the separation roller 42.

A first nip position N1 is defined as a position where a sheet SH is nipped by the separation roller 42 and the separation piece 43 as shown in FIGS. 7 and 8 when the sheet SH is fed.

As shown in FIG. 4, the inclined surface 130 is positioned on the end portion (91E) (end portion (91EE)) of the sheet supporting surface 91A positioned on the downstream side in the conveyance direction. Further, as shown in FIGS. 3, 4, 7, and 8, the inclined surface 130 extends toward the left side, that is, toward the downstream side in the conveyance direction, and is inclined with respect to the sheet supporting surface 91A so as to approach the separation roller 42.

As shown in FIGS. 4 to 6, inside the opening 93H, the pinch rollers 100 are supported by the holding unit 120. That is, the pinch rollers 100 are provided to be able to contact the sheet SH from the same side as the sheet supporting surface 91A if the sheets SH are fed from the feeding tray 91. As shown in FIGS. 7 and 8, the pinch rollers 100 are positioned on the right side with respect to the first nip position N1, that is, on the upstream side with respect to the first nip position N1 in the conveyance direction.

More specifically, as shown in FIGS. 4 and 6, the pinch rollers 100 are disposed in the vicinity of the inner wall of the front side of the opening 93H and in the vicinity of the inner wall of the front side of the opening 93H, respectively. The pinch roller 100 positioned on the front side and the other pinch roller 100 positioned on the rear side are identical components, and are different from each other only in their directions.

As shown in FIG. 6, each pinch roller 100 is formed by integrally forming a main pinch roller body 101, a shaft part 102, and a locking part 103. The main pinch roller body 101 has a disc shape having a second shaft center X2 as a central axis. The shaft part 102 is columnar shaft, which has the second shaft center X2 as a central axis and protrudes from the main pinch roller body 101. The locking part 103 protrudes outward in a radial direction from an end portion of the shaft part 102 positioned on the opposite side to the main pinch roller body 101, so as to have a flange shape. In each pinch roller 100, the outer circumferential surface (100A) of the main pinch roller body 101 is formed of rubber, and the other part is formed of a resin. That is, the outer layer 100S of each pinch roller 100 is formed of rubber.

As shown in FIGS. 5 and 6, the holding unit 120 is formed by integrally forming a bottom wall portion 121 and a pair of front and rear side wall portions 122. The bottom wall portion 121 extends in the front-rear direction and has a rectangular plate shape, and the side wall portions 122 protrude upward from the front end portion and rear end portion of the bottom wall portion 121, respectively.

As shown in FIG. 6, each side wall portion 122 is cut out downward from its upper end edge, whereby a shaft receiving groove 122C is formed. The shaft parts 102 of the pinch rollers 100 are fit into the shaft receiving grooves 122C, respectively, whereby the pinch rollers 100 are supported by the holding unit 120 so as to be rotatable around the second shaft center X2 extending in the front-rear direction. The second shaft center X2 is positioned on the right side with respect to the first shaft center X1, that is, on the upstream side with respect to the first shaft center X1 in the conveyance direction.

As shown in FIGS. 5 and 6, each side wall portion 122 protrudes toward the right side, and has a shaft part 122S formed at its right end portion. The shaft part 122S of the front side and the shaft part 122S of the rear side are columnar shafts, which have a fourth shaft center X4 extending in the front-rear direction, as a central axis. The shaft part 122S of the front side and the shaft part 122S of the rear side protrude so as to approach each other.

As shown in FIG. 6, the shaft parts 122S of the holding unit 120 are fit into the shaft receiving portions 93T of the chute member (93), whereby the holding unit 120 is supported by the chute member 93 so as to be able to swing around the fourth shaft center X4. The fourth shaft center X4 is positioned on the right side with respect to the first shaft center X1 and the second shaft center X2. That is, the fourth shaft center X4 is positioned on the upstream side with respect to the separation roller 42 and the pinch rollers 100 in the conveyance direction.

The bottom wall portion 121 of the holding unit 120 is positioned on the lower side with respect to the base portion 151 of the separation piece holder 150. The side wall portion 122 of the front side of the holding unit 120 and the front pinch roller 100 are positioned between the base portion 151 and front protruding portion 152 of the separation piece holder 150. The side wall portion 122 of the rear side of the holding unit 120 and the rear pinch roller 100 are positioned between the base portion 151 and rear protruding portion 152 of the separation piece holder 150.

As shown in FIG. 3, on the lower side from the opening 93H of the chute member 93, a guide member 94 is disposed. The guide member 94 defines the portion of the conveyance path P1 passing the read surface 82A and leading to the discharge tray 92, from the above.

Between the bottom wall portion 121 of the holding unit 120 and the guide member 94, a compression spring 100T is disposed. The holding unit 120 swings around the fourth shaft center X4, whereby the pinch rollers 100 advance or retreat with respect to the separation roller 42. The compression spring 100T presses the bottom wall portion 121 upward, whereby the pinch rollers 100 are pressed against the separation roller 42. As a result, each pinch roller 100 may be driven to rotate around the second shaft center X2 by the separation roller 42 while abutting on the separation roller 42.

A second nip position N2 is defined as a position where a sheet SH is nipped by the separation roller 42 and the pinch rollers 100 as shown in FIGS. 7 and 8 when the sheet SH is fed. An extension plane which extends from the sheet supporting surface 91A toward the left side, that is, toward the downstream side in the conveyance direction is denoted by a reference symbol E1.

As shown in FIG. 7, a distance L1 between the sheet supporting surface 91A and the feeding roller 41 being at the maximum separation position is equal to a distance L2 between the second nip position N2 and the extension plane E1 extending from the sheet supporting surface 91A toward the downstream side in the conveyance direction. Here, the expression "the distance L1 is equal to the distance L2" includes not only a case where the distance L1 and the distance L2 are completely equal to each other, but also a case where the distance L1 and the distance L2 are slightly different from each other. As seen from the front-rear direction, the second shaft center X2 is on the extension plane E1 extending from the sheet supporting surface 91A toward the downstream side in the conveyance direction.

As shown in FIGS. 7 and 8, as seen from the front-rear direction, each pinch roller 100 includes a portion 100D which overlaps the separation piece 43. As seen from the front-rear direction, the inclined surface 130 includes portions 130D which overlap the pinch rollers 100, respectively.

As seen from the front-rear direction, the extension plane E1 extending from the sheet supporting surface 91A toward the downstream side in the conveyance direction extends below the outer circumferential surface 42A of the separation roller 42 with a gap. As seen from the front-rear direction, the outer circumferential surface 100A of each pinch roller 100 (main pinch roller body 101) includes an arc 100C. The arc 100C extends from a position adjacent to the end portion 91EE which is included in the end portion 91E of the sheet supporting surface 91A positioned on the downstream side in the conveyance direction, to the second nip position N2, while swelling upward toward the separation roller 42.

As shown in FIG. 3, the conveyor 4 includes a conveying roller 44 and pinch rollers 44P, which are provided in the substantially horizontal portion of the upper path of the conveyance path P1 so as to be positioned on the left side with respect to the separation roller 42 and the separation piece 43, that is, on the downstream side with respect to them in the conveyance direction. The conveyor 44 and the pinch rollers 44P nip each sheet SH separated by the separation roller 42 and the separation piece 43, and conveys the corresponding sheet SH to the downstream side in the conveyance direction.

The conveyor 4 includes a conveying roller 45 having a large diameter, a curved guide surface 45G, and pinch rollers 45P and 45Q, which are provided in the portion of the conveyance path P1 curved downward and making the U-turn. The outer circumferential surface of the conveying roller 45 forms an inner guide surface of the portion of the conveyance path P1 curved downward and making the U-turn. The curved guide surface 45G is disposed with a predetermined gap from the outer circumferential surface of the conveying roller 45. The curved guide surface 45G forms an outer guide surface of the portion of the conveyance path P1 curved downward and making the U-turn. The conveying roller 45 conveys each sheet SH to the read surface 82A, in cooperation with the pinch rollers 45P and 45Q abutting on the outer circumferential surface of the conveying roller 45.

The conveyor 4 includes a pressing member 49 which is disposed at a position facing the read surface 82A from the above. If a sheet SH is conveyed from the conveying roller (45), the pressing member 49 presses the sheet SH from the above, thereby coming the sheet SH into contact with the read surface 82A.

The conveyor 4 includes a discharging roller 48 and pinch rollers 48P which are disposed in a portion of the conveyance path P1 positioned on the right side with respect to the pressing member 49 and inclined upward. The discharging roller 48 and the pinch rollers 48P are adjacent to the discharge tray 92. If a sheet SH passes the read surface 82A, the discharging roller 48 and the pinch rollers 48P discharge the sheet SH onto the discharge tray 92.

<Image Reading Operation>

In the image reading apparatus 1, in a case of reading the image of a document supported on the document supporting surface 81A, the scanning mechanism (not shown) of the reading unit 3 operates such that the read sensor 3S moves in the left-right direction between the lower side of the left end edge of the document supporting surface 81A and the lower side of the right end edge of the document supporting surface 81A, whereby the read sensor 3S reads the image of the document supported on the document supporting surface 81A. Thereafter, the scanning mechanism (not shown) operates such that the read sensor 3S moves from the right end side to the left end side in the reading unit 3, thereby returning to the original position.

Also, in the image reading apparatus 1, in a case of reading the images of sheets SH put on the feeding tray 91, the scanning mechanism (not shown) of the reading unit 3 operates such that the read sensor 3S stops at a predetermined read position below the read surface 82A. The read sensor 3S which is at the predetermined read position is located on the downstream side with respect to the separation roller 42 in the conveyance direction. If the sheets SH on the feeding tray 91 are sequentially conveyed along the conveyance path P1 by the conveyor 4, since each sheet SH passes the upper side of the read sensor 3S being at the predetermined read position while being in contact with the read surface 82A, the read sensor 3S reads the image of the corresponding sheet SH. After the image of the sheet SH is read, the sheet SH is discharged onto the discharge tray 92 by the discharging roller 48 and the pinch rollers 48P.

<Advantages>

In the image reading apparatus 1 of the first illustrative embodiment, as shown in FIG. 7, if the number of sheets SH stacked on the sheet supporting surface 91A is large, the leading end of the uppermost sheet SH is likely to first come into contact with the separation roller 42. Then, the leading end of the corresponding sheet SH is guided to the separation roller 42 rotating, thereby being nipped at the second nip position N2 by the separation roller 42 and the pinch rollers 100, and then reaches the first nip position N1.

Meanwhile, in the image reading apparatus 1, as shown in FIG. 8, if the number of sheets SH stacked on the sheet supporting surface 91A is small, the leading end of the uppermost sheet SH is likely to first come into contact with the outer layers 100S of the pinch rollers 100. Then, the leading end of the corresponding sheet SH is guided by the pinch rollers 100 driven to rotate by the separation roller 42, thereby being nipped at the second nip position N2 by the separation roller 42 and the pinch rollers 100, and then reaches the first nip position N1.

That is, in the image reading apparatus 1, the leading end of each sheet SH is nipped at the second nip position N2 by the separation roller 42 and the pinch rollers 100, and then reaches the first nip position N1. Therefore, regardless of the number of sheets SH stacked on the sheet supporting surface 91A, the trajectory of the leading end of each sheet SH which is fed from the feeding tray 91 to the separation roller 42 is stable. Since the leading end of each sheet SH which is conveyed along the stable trajectory reaches the first nip position N1 positioned on the downstream side with respect to the second nip position in the conveyance direction, it is possible to stabilize the accuracy of separation of each sheet SH at the first nip position N1.

Also, in the image reading apparatus 1, if the separation piece 43 is simply arranged in series with the pinch rollers 100 in the conveyance direction, that is, in the left-right direction, in the substantially horizontal portion of the upper path of the conveyance path P1, a space (the length in the conveyance direction) for disposing the separation piece 43 and the pinch rollers 100 needs at least a length which is the sum of the length of the separation piece 43 in the conveyance direction and the length of one pinch roller 100 in the conveyance direction, that is, the outside diameter of one pinch roller body 101. Therefore, it becomes difficult to reduce the size of the apparatus in the left-right direction which is the conveyance direction. In contrast to this, in the image reading apparatus 1, as shown in FIGS. 7 and 8, as seen from the front-rear direction, the pinch rollers 100 include the portions 100D which overlap the separation piece 43. Therefore, a space (the length in the conveyance direction) for disposing the separation piece 43 and the pinch rollers 100 may be reduced in the left-right direction.

Therefore, in the image reading apparatus 1 of the first illustrative embodiment, regardless of the number of sheets SH stacked on the sheet supporting surface 91A, it is possible to reliably separate the sheets SH one at a time. Further, it is possible to reduce the size of the apparatus.

Also, in the image reading apparatus 1, as shown in FIG. 7, the distance L1 between the sheet supporting surface 91A and the feeding roller 41 being at the maximum separation position is equal to the distance L2 between the second nip position N2 and the extension plane E1 extending from the sheet supporting surface 91A toward the downstream side in the conveyance direction. Therefore, in the image reading apparatus 1, it is possible to reduce the size of the apparatus in the height direction Dh while increasing the maximum number of sheets SH which can be stacked on the sheet supporting surface 91A.

Further, in the image reading apparatus 1, as shown in FIGS. 7 and 8, as seen from the front-rear direction, the second shaft center X2 is on the extension plane E1 extending from the sheet supporting surface 91A toward the downstream side in the conveyance direction. Therefore, in the image reading apparatus 1, it is possible to reliably guide the leading end of each sheet SH toward the first nip position N1 by the pinch rollers 100 while increasing the maximum number of sheets SH which can be stacked on the sheet supporting surface 91A.

Also, in the image reading apparatus 1, as seen from the front-rear direction, the inclined surface 130 includes the portions 130D which overlap the pinch rollers 100, respectively. Therefore, in the image reading apparatus 1, even in a section between the sheet supporting surface 91A and the pinch rollers 100, it is possible to reliably guide the leading end of each sheet SH by the inclined surface 130.

Further, in the image reading apparatus 1, as shown in FIGS. 4 to 6, the pinch rollers 100 are supported by the holding unit 120 so as to be able to advance or retreat with respect to the separation roller 42. Therefore, in the image reading apparatus 1, when the user sets a sheet SH on the sheet supporting surface 91A, even if the sheet SH is strongly inserted between the separation roller 42 and the pinch rollers 100, since the pinch rollers 100 retreat with respect to the separation roller 42, it is possible to suppress problems such as a problem in which the leading end of the sheet SH is folded.

Also, in the image reading apparatus 1, the pinch rollers 100 are held by the holding unit 120 swinging around the fourth shaft center X4 positioned on the right side with respect to the separation roller 42, that is, on the upstream side with respect to the separation roller 42 in the conveyance direction. Therefore, for example, as compared to a case of using a configuration in which the holding unit moves linearly, it is possible to reduce the size of the apparatus in the height direction Dh.

Further, in the image reading apparatus 1, the outer circumferential surface side of each main pinch roller body 101 is formed of rubber as the outer layer 100S of a corresponding pinch roller 100. Therefore, in the image reading apparatus 1, it becomes difficult for the leading end of a sheet SH being in contact with the outer layers 100S of the pinch rollers 100 to slip from the pinch rollers 100, and thus it is possible to more reliably guide the leading end of each sheet SH by the pinch rollers 100.

Also, in the image reading apparatus 1, since the separating performance of the separation roller 42 and the separation piece 43 is stable due to the pinch rollers 100, it is possible to stabilize the image reading quality of the read sensor 3S positioned on the downstream side with respect to the separation roller 42 in the conveyance direction.

(Second Illustrative Embodiment)

Figure 9:
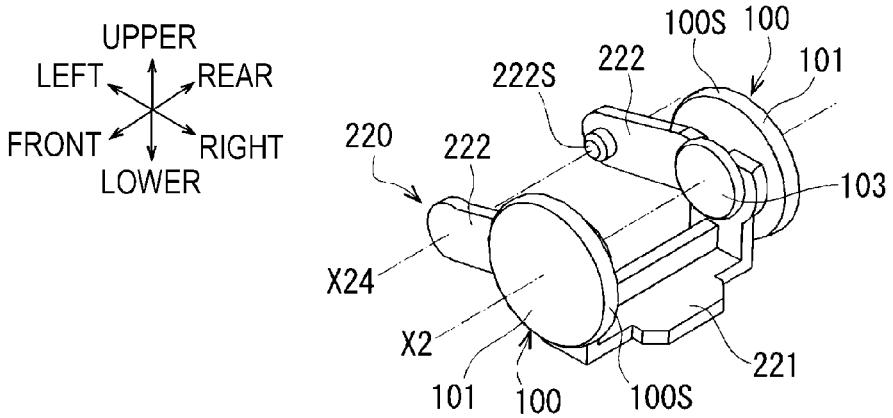
FIG. 9 is a perspective view illustrating pinch rollers and a holding unit of an image reading apparatus of a second illustrative embodiment.
Figure 10:
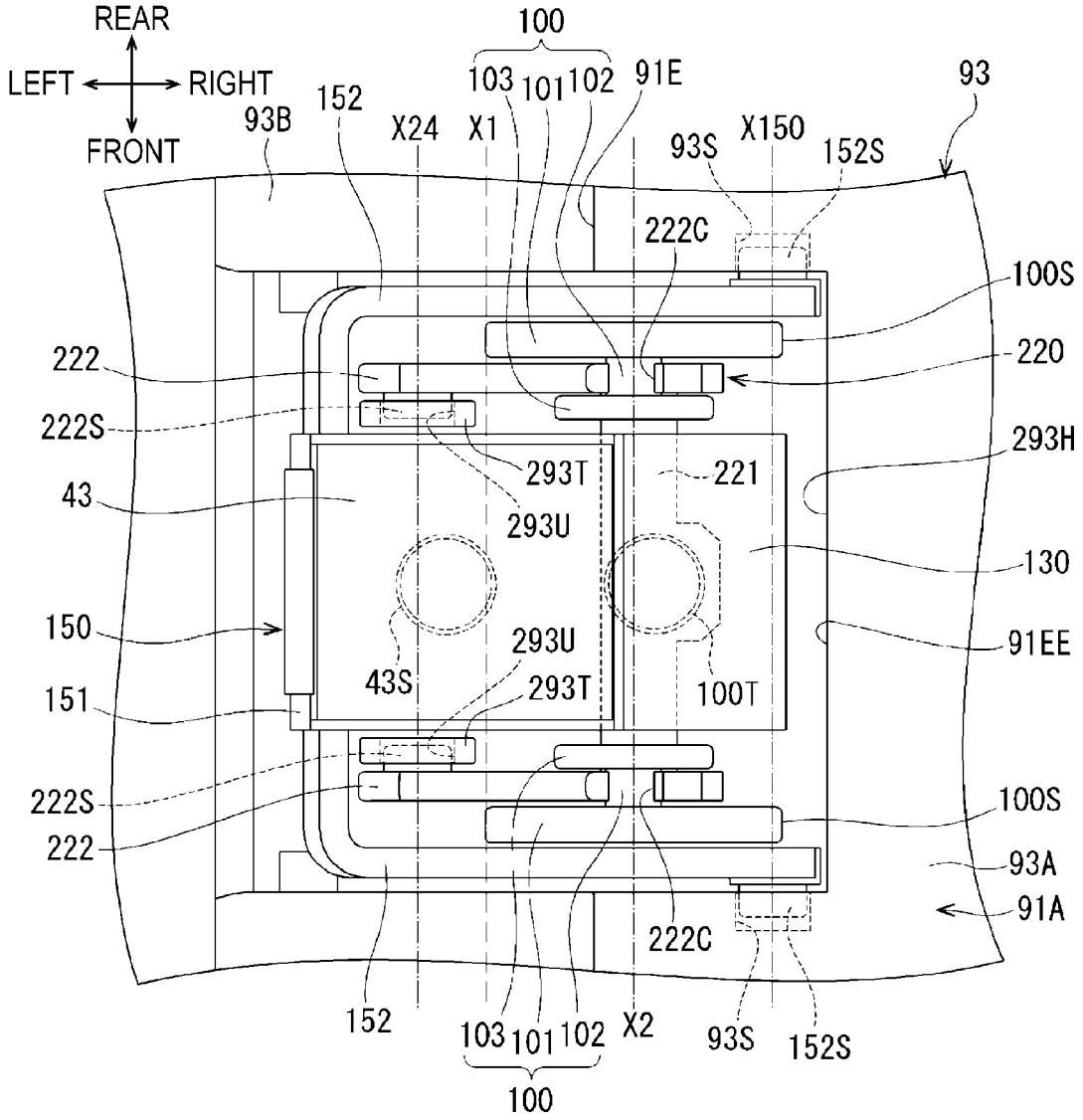

As shown in FIGS. 9 and 10, an image reading apparatus of a second illustrative embodiment uses a holding unit 220 instead of the holding unit 120 of the image reading apparatus 1 of the first illustrative embodiment. The other configuration of the second illustrative embodiment is the same as that of the first illustrative embodiment. Therefore, components identical to those of the first illustrative embodiment are denoted by the same reference symbols, and will be described in brief or will not be described.

In the image reading apparatus of the second illustrative embodiment, as shown in FIG. 10, the size of an opening 293H in the left-right direction is smaller than that of the opening 93H of the first illustrative embodiment.

As shown in FIG. 10, on the left side of the opening 293H, a pair of front and rear protrusions 293T are formed. The protrusions 293T protrudes upward from the bottom of the opening 293H. The front protrusion 293T is positioned between the base portion 151 and front protruding portion 152 of the separation piece holder 150. The rear protrusion 293T is positioned between the base portion 151 and rear protruding portion 152 of the separation piece holder 150. In each protrusion 293T, a shaft hole 293U is formed.

As shown in FIGS. 9 and 10, the holding unit 220 is formed by integrally forming a bottom wall portion 221 and a pair of front and rear side wall portions 222. The bottom wall portion 221 extends in the front-rear direction and has a rectangular plate shape, and the side wall portions 222 protrude upward from the front end portion and rear end portion of the bottom wall portion 221, respectively. The bottom wall portion 221 has the same configuration as that of the bottom wall portion 121 of the first illustrative embodiment.

As shown in FIG. 10, each side wall portion 222 is cut out downward from its upper end edge, whereby a shaft receiving groove 222C is formed. The shaft parts 102 of the pinch rollers 100 are fit into the shaft receiving grooves 222C, respectively, whereby the pinch rollers 100 are being supported by the holding unit 120 so as to be rotatable around the second shaft center X2.

As shown in FIGS. 9 and 10, each side wall portion 222 protrudes toward the left side, and has a shaft part 222S formed at its left end portion. The shaft part 222S of the front side and the shaft part 222S of the rear side are columnar shafts, which have a fourth shaft center X24 extending in the front-rear direction, as a central axis. The shaft part 222S of the front side and the shaft part 222S of the rear side protrude so as to approach each other.

As shown in FIG. 10, the shaft parts 222S of the holding unit 220 are fit into the shaft holes 293U formed in the protrusions 293T, whereby the holding unit 220 is supported by the chute member 93 so as to be able to swing around the fourth shaft center X24. The fourth shaft center X24 is positioned on the left side with respect to the first shaft center X1, that is, on the downstream side with respect to the separation roller 42 in the conveyance direction.

The side wall portion 222 of the front side of the holding unit 220 and the front pinch roller 100 are positioned between the base portion 151 and front protruding portion 152 of the separation piece holder 150. The side wall portion 222 of the rear side of the holding unit 220 and the rear pinch roller 100 are positioned between the base portion 151 and rear protruding portion 152 of the separation piece holder 150. The holding unit 220 swings around the fourth shaft center X24, whereby the pinch rollers 100 advance or retreat with respect to the separation roller 42.

In the image reading apparatus of the second illustrative embodiment configured as described above, similarly to the image reading apparatus 1 of the first illustrative embodiment, regardless of the number of sheets SH stacked on the sheet supporting surface 91A, it is possible to reliably separate the sheets SH one at a time. Further, it is possible to reduce the size of the apparatus.

Also, in this image reading apparatus, the pinch rollers 100 are held by the holding unit 220 swinging around the fourth shaft center X24 positioned on the downstream side with respect to the separation roller 42 in the conveyance direction. Therefore, for example, as compared to a case of using a configuration in which the holding unit moves linearly, it is possible to reduce the size of the apparatus in the height direction Dh shown in some drawings such as FIG. 3.

(Third Illustrative Embodiment)

Figure 11:
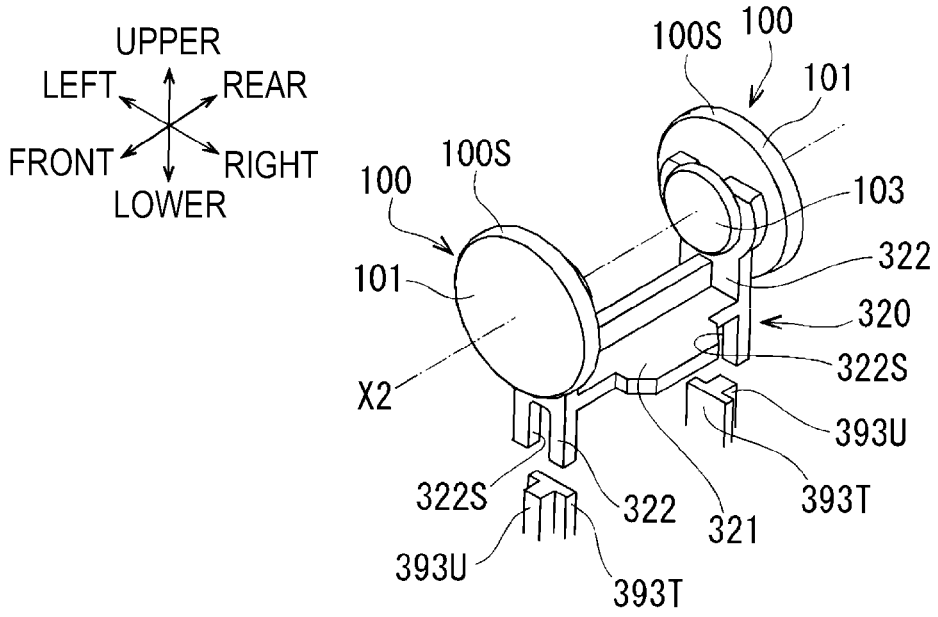
FIG. 11 is a perspective view illustrating pinch rollers and a linear motion type holding unit of an image reading apparatus of a third illustrative embodiment.

As shown in FIG. 11, an image reading apparatus of a third illustrative embodiment uses a linear motion type holding unit 320 instead of the holding unit 120 of the image reading apparatus 1 of the first illustrative embodiment. The other configuration of the third illustrative embodiment is the same as that of the first illustrative embodiment. Therefore, components identical to those of the first illustrative embodiment are denoted by the same reference symbols, and will be described in brief or will not be described.

In the image reading apparatus of the third illustrative embodiment, in the opening 93H (not shown), a pair of front and rear protrusions 393T are formed. The protrusions 393T protrude upward from the bottom of the opening 93H (not shown). Although not shown in FIG. 11, the front protrusion 393T is positioned between the base portion 151 and front protruding portion 152 of the separation piece holder 150. The rear protrusion 393T is positioned between the base portion 151 and rear protruding portion 152 of the separation piece holder 150. On the front surface of the front protrusion 393T and the rear surface of the rear protrusion 393T, guide rails 393U are formed in a rib shape so as to extend downward from their upper end portions.

The linear motion type holding unit 320 is formed by integrally forming a bottom wall portion 321 and a pair of front and rear side wall portions 322. The bottom wall portion 221 extends in the front-rear direction and has a rectangular plate shape, and the side wall portions 322 protrude upward and downward from the front end portion and rear end portion of the bottom wall portion 221, respectively. The bottom wall portion 321 has the same configuration as that of the bottom wall portion 121 of the first illustrative embodiment.

Although not shown in FIG. 11, in each side wall portion 322, a shaft receiving groove identical to the shaft receiving grooves 122C formed in the side wall portions 122 of the first illustrative embodiment is formed. The shaft parts 102 of the pinch rollers 100 are fit into the shaft receiving grooves, respectively, whereby the pinch rollers 100 are supported by the linear motion type holding unit 120 so as to be rotatable around the second shaft center X2.

The portions of the side wall portions 322 protruding downward from the bottom wall portion 321 are cut out upward from their lower end portions, whereby guide grooves 322S are formed.

The guide rails 393U formed on the protrusions 393T are inserted into the guide grooves 322S of the linear motion type holding unit 320, respectively. As a result, the linear motion type holding unit 320 is supported by the chute member 93 so as to be linearly movable in a vertical direction, and operates such that the pinch rollers 100 linearly advance or retreat with respect to the first shaft center X1.

In the image reading apparatus of the third illustrative embodiment configured as described above, similarly to the image reading apparatuses 1 of the first and second illustrative embodiments, regardless of the number of sheets SH stacked on the sheet supporting surface 91A, it is possible to reliably separate the sheets SH one at a time. Further, it is possible to reduce the size of the apparatus.

Also, in this image reading apparatus, the linear motion type holding unit 320 is not bulky in the left-right direction. Therefore, it is easy to reduce the size of the apparatus in the left-right direction.

Although the present invention has been described above on the basis of the first to third illustrative embodiments, the present invention is not limited to the above-described first to third illustrative embodiment, and can be appropriately modified and applied without departing from the scope of the present invention.

In the first illustrative embodiment, the separation roller 42 is provided so as to be able to contact the sheet SH fed from the feeding tray 91, from the side that is opposite to the side facing the sheet supporting surface 91A, such that the uppermost sheet SH is first fed to the separation roller 42. However, the present invention is not limited thereto. For example, the separation roller may be provided so as to be able to contact the sheet fed from the feeding tray, from the same side as the sheet supporting surface, such that the lowermost sheet is first fed to the separation roller.

In the illustrative embodiments, as seen from the width direction, the second shaft center X2 is on the extension plane E1 extending from the sheet supporting surface 91A toward the downstream side in the conveyance direction. However, the present invention is not limited thereto. As seen from the width direction, the second shaft center may be located across the extension plane, which extends from the sheet supporting surface toward the downstream side in the conveyance direction, from the separation roller.

In the illustrative embodiments, the outer layers 100S of the pinch rollers 100 are formed of rubber. However, the present invention is not limited thereto. At least the outer layers of the pinch rollers may be friction members such as elastomer or sponge. Alternatively, the whole of each pinch roller may be formed of a resin.

The present invention can be applied to apparatuses such as an image reading apparatus, an image forming apparatus, and a multi-function apparatus.

What is claimed is:

1. A sheet separating apparatus comprising:

a stacker including a sheet supporting surface for supporting a sheet;

a separation roller configured to rotate around a first shaft center that is parallel to a width direction of the sheet supporting surface, wherein the separation roller is configured to contact the sheet fed from the stacker and to convey the sheet to a downstream side in a conveyance direction that is perpendicular to the width direction;

a separation piece, which faces the separation roller, and which is configured to separate the sheet one at a time in cooperation with the separation roller, the separation roller and the separation piece being configured to nip the sheet being fed at a first nip position; and a pinch roller, which is provided on an upstream side with respect to the first nip position in the conveyance direction, and which is configured to abut on the separation roller so as to be rotatable around a second shaft center, which is parallel to the width direction, by a rotation of the separation roller, wherein the pinch roller is abuttable on the separation roller at a second nip position that is on the upstream side of the first nip position in the conveyance direction; and an inclined surface, which is provided on an end portion of the sheet supporting surface at the downstream side in the conveyance direction, and which extends toward the downstream side in the conveyance direction while being inclined with respect to the sheet supporting surface so as to approach the separation roller, wherein the pinch roller has a portion overlapping the separation piece as seen from the width direction, and wherein the inclined surface includes a portion overlapping the pinch roller as seen from the width direction.

2. The sheet separating apparatus according to claim 1, wherein the separation roller is provided to be contactable with the sheet fed from the stacker, from a side opposite to a side facing the sheet supporting surface, and wherein the pinch roller is provided to be contactable with the sheet fed from the stacker, from the same side as the sheet supporting surface.

3. The sheet separating apparatus according to claim 2, further comprising:

a feeding roller, which is provided on the upstream side with respect to the separation roller in the conveyance direction so as to face the sheet supporting surface, and which is configured to rotate around a third shaft center that is parallel to the width direction, wherein the feeding roller is configured to contact the sheet supported on the sheet supporting surface and to feed the sheet toward the separation roller.

4. The sheet separating apparatus according to claim 3, wherein the feeding roller is configured to be displaceable between a first position where the feeding roller contacts the sheet supporting surface and a second position where the feeding roller is farthest from the sheet supporting surface, and wherein in a case of defining a second nip position as a position where the sheet being fed is nipped by the separation roller and the pinch roller, a distance between the sheet supporting surface and the feeding roller being at the second position is substantially equal to a distance between the second nip position and an extension plane extending from the sheet supporting surface to the downstream side in the conveyance direction.

5. The sheet separating apparatus according to claim 2, wherein as seen from the width direction, the second shaft center is positioned on an extension plane extending from the sheet supporting surface toward the downstream side in the conveyance direction, or the second shaft center is located across the extension plane from the separation roller.

6. The sheet separating apparatus according to claim 1, wherein the pinch roller is configured to advance or retreat with respect to the separation roller.

7. The sheet separating apparatus according to claim 6, further comprising:

a holding unit configured to hold the pinch roller and to swing around a fourth shaft center that is parallel to the width direction so as to allow the pinch roller advance or retreat with respect to the separation roller, wherein the fourth shaft center is positioned on the upstream side from the separation roller in the conveyance direction.

8. The sheet separating apparatus according to claim 6, further comprising:

a holding unit configured to hold the pinch roller and to swing around a fourth shaft center that is parallel to the width direction so as to allow the pinch roller advance or retreat with respect to the separation roller, wherein the fourth shaft center is positioned on the downstream side with respect to the separation roller in the conveyance direction.

9. The sheet separating apparatus according to claim 6, further comprising:

a holding portion configured to hold the pinch roller and to allow the pinch roller advance or retreat linearly with respect to the first shaft center.

10. The sheet separating apparatus according to claim 1, wherein at least an outer layer of the pinch roller is made of a friction member.

11. The sheet separating apparatus according to claim 1, further comprising:

a reading unit, which is provided on the downstream side with respect to the separation roller in the conveyance direction, and which is configured to read an image of the sheet separated and conveyed by the separation roller and the separation piece.

12. The sheet separating apparatus according to claim 1, wherein the pinch roller comprises a pair of pinch rollers, each of the pinch roller is arranged further than a respective end of the separation piece in the width direction.

13. A sheet separating apparatus comprising:

a stacker including a sheet supporting surface for supporting a sheet;

a separation roller configured to rotate around a first shaft center that is parallel to a width direction of the sheet supporting surface, wherein the separation roller is configured to contact the sheet fed from the stacker and to convey the sheet to a downstream side in a conveyance direction that is perpendicular to the width direction;

a separation piece held by a separation piece holder so as to face the separation roller, the separation piece being configured to separate the sheet one at a time in cooperation with the separation roller, the separation roller and the separation piece being configured to nip the sheet being fed at a first nip position;

a pinch roller, which is provided on an upstream side with respect to the first nip position in the conveyance direction, and which is configured to abut on the separation roller so as to be rotatable around a second shaft center, which is parallel to the width direction, by a rotation of the separation roller, the separation roller and the pinch roller are configured to nip the sheet being fed at a second nip position;

a chute member including a first part positioned on an upstream side of the separation roller and a second part positioned on a downstream side of the separation roller, wherein the chute member includes the sheet supporting surface and defines a recess positioned downstream of the first part and having the pinch roller and the separation piece holder situated therein, the sheet supporting surface including an upper surface of the stacker and an upper surface of the first part, wherein as seen from the width direction, an extension plane extends from the sheet supporting surface toward the downstream side in the conveyance direction, with a gap from an outer circumferential surface of the separation roller, and wherein the outer circumferential surface of the pinch roller includes an arc that extends from a position adjacent to an end portion of the sheet supporting surface at the downstream side in the conveyance direction to the second nip position while protruding toward the separation roller.

14. The sheet separating apparatus according to claim 13, wherein the recess includes first and second walls, each of the walls defining an opening, and wherein the separation piece holder includes a pivot shaft received by the openings in the walls of the recess.

15. The sheet separating apparatus according to claim 13, wherein the recess includes first and second walls, each of the walls defining an opening, and wherein the pinch roller includes a pair of pinch rollers supported by a pinch roller holding unit that includes shaft parts received by the openings in the walls of the recess.

16. A sheet separating apparatus comprising:

a stacker including a sheet supporting surface for supporting a sheet;

a separation roller configured to rotate around a first shaft center that is parallel to a width direction of the sheet supporting surface, wherein the separation roller is configured to contact the sheet fed from the stacker and to convey the sheet to a downstream side in a conveyance direction that is perpendicular to the width direction;

a separation piece, which faces the separation roller, and which is configured to separate the sheet one at a time in cooperation with the separation roller, the separation roller and the separation piece being configured to nip the sheet being fed at a first nip position; and a pinch roller, which is provided on an upstream side with respect to the first nip position in the conveyance direction, and which is configured to abut on the separation roller so as to be rotatable around a second shaft center, which is parallel to the width direction, by a rotation of the separation roller, wherein the pinch roller is abuttable on the separation roller at a second nip position that is on the upstream side of the first nip position in the conveyance direction;

a holding unit configured to hold the pinch roller, the holding unit being swingable around a third shaft center; and a separation piece holder that is independent from the holding member and is configured to support the separation piece, the separation holder being swingable around a fourth shaft center, wherein the pinch roller comprises first and second pinch rollers positioned on opposite sides of the separation piece such that the separation piece sandwiched between the first and second pinch rollers, and wherein the first and second pinch rollers have a portion overlapping the separation piece as seen from the width direction.

* * * * *